United States Patent [19]

Witt

[11] 4,304,395

[45] Dec. 8, 1981

[54] BEARING PAD FOR SUPPORTING A BRACE FOR A HIGHWAY FENCE

[76] Inventor: Samuel Witt, Rte. 1, Box 313, Fishersville, Va. 22939

[21] Appl. No.: 18,855

[22] Filed: Mar. 8, 1979

[51] Int. Cl.[3] ..... E04H 17/04

[52] U.S. Cl. ..... 256/64; 256/35

[58] Field of Search ..... 256/64, 35, 31, 13.1, 256/DIG. 5; 52/146, 155, 165

[56] References Cited

U.S. PATENT DOCUMENTS

| | | | |
|---|---|---|---|
| 165,557 | 7/1875 | Geer | 52/165 |
| 199,949 | 2/1878 | Youngs | 52/165 |
| 291,927 | 1/1884 | Newton | 52/165 |
| 1,176,983 | 3/1916 | Phillips | 52/146 |
| 1,308,939 | 7/1919 | Eggleston | 52/155 |
| 2,199,518 | 5/1940 | Coleman | 52/146 |
| 4,112,638 | 9/1978 | Hanson, Sr. | 52/165 X |

*Primary Examiner*—Andrew V. Kundrat

*Attorney, Agent, or Firm*—Auzville Jackson, Jr.

[57] ABSTRACT

A bearing pad for supporting a strut serving to sustain a highway fence or the like and method for using it is shown wherein the pad is adapted to be driven into the soil to support the strut. The pad has a large planar bearing surface for engagement with the soil and is provided with a driving point and a strut engaging socket. The pad also has integral guide fins for directing its movement into the soil so that the pad can be accurately positioned in the soil at a right angle with respect to the length of the strut to provide a maximum bearing surface against which any thrust directed against the fence can be transferred to the strut to be dissipated in the soil.

6 Claims, 4 Drawing Figures

BEARING PAD FOR SUPPORTING A BRACE FOR A HIGHWAY FENCE

BACKGROUND

Various bracing pads for supporting the corner posts of a fence or the intermediate posts in a line of fence posts are known as exemplified in various United States patents. For example, U.S. Pat. No. 781,537 to Lower, Jan. 31, 1905; U.S. Pat. No. 1,504,494 to Parsons, Aug. 12, 1924; U.S. Pat. No. 1,981,447 to Clark, Nov. 20, 1934 and U.S. Pat. No. 2,199,518 to Coleman, May 7, 1940, show corner post braces that are designed to hold these posts erect against the tension of the fencing. The first two of these patents show bearing supports positioned in the soil some distance from the corner post along the line of the fence, the bearing means being positioned vertically in the soil to support a brace carried at one end on the post and on the other end on the bearing. The second two of these patents show no more than stakes driven into the ground to support braces that lie in the plane of the fencing. The bearing area supplied by such stake-like bearing supports provides only a minimum of exposed area to support the braces and could not sustain the loads for which the bracing means of the present invention is likely to be subjected in the environment in which it is adapted to be used.

Bracing means to support posts in line along a fence are shown in U.S. Pat. No. 26,727 to Kimball, July 25, 1882; U.S. Pat. No. 774,099 to Narsh, Nov. 1, 1904 and 852,421 to Davis, May 7, 1907. Kimball shows a brace with an integral foot that serves as a bearing means adapted to be driven vertically in the ground.

U.S. Pat. No. 453,148 to Kiler et al, May 26, 1891; U.S. Pat. No. 994,742 to Gregory, June 13, 1911 and U.S. Pat. No. 3,334,867 to Wenaas, Aug. 8, 1967, all show bracing means disposed between adjacent posts in a fence wherein the braces are strung from the top of one post to the bottom of an adjoining post. Tightening means are provided and thus in Kiler et al, guy wire E' is provided including a turnbuckle. Gregory provides tensioned wire strands to hold his posts erect and Wenaas shows diagonal bracking bolted into place between posts that are the correct distance from each other.

U.S. Pat. 2,199,518 to Coleman, May 7, 1940, shows a pipe means having one end flattened and bent at a right angle to the length of the pipe that can be buried in the ground to form a brace for a fence post. Apparently the brace and post of this disclosure are assembled together and then they are anchored in the ground.

BRIEF DESCRIPTION OF THIS INVENTION

The bearing pad here shown for supporting one end of a brace for a fence has a large planar surface for engagement with the soil and when it is driven home in the soil, it is disposed at a right angle with respect to the longitudinal axis of the brace or fence supporting strut that is rigidly engaged between the fence and the pad. For supporting the fence, the upper end of the strut is engaged in a bearing means on a post on which the fence is carried, and with the bearing pad supporting the other end of the strut, the pad is disposed to present a maximum bearing area to the soil for dissipating any thrust imposed upon the brace.

The bearing pad is provided with a driving point on one edge surface that is initially guided into the soil as the pad is held with one hand and driven downwardly with a sledge hammer. The point has a sufficient length to support the pad fully after a few preliminary taps with the hammer in order to free the hands of the mechanic allowing him to take full swings with the sledge to complete the driving of the pad into the soil.

The point, as well as the body of the bearing pad, has integral rib means on its front and rear planar surfaces that serve to guide the pad into the soil in the direction in which it is initially started. These ribs also stiffen the pad to allow the structure to sustain the load transferred to the pad without deflection and resist sidewise movement in event of eccentric loading.

The procedure for driving the pad into the soil can provide for automatically tightening the strut in position between its bearing supports on the fence and on the bearing pad. By positioning the planar pad at the proper angle and driving it into the soil so that the strut is ultimately disposed at a right angle with respect to the plane of the pad, the strut will have then assumed a properly aligned and snugly seated position in its bearing seats.

It is therefore an object of this invention to provide an improved rugged bearing pad adapted to be driven into the soil for holding a brace or strut designed to support a fence or the like.

Another object is to provide a bearing pad adapted to be more easily driven into position in the soil.

Another object to provide a bearing pad for an angularly disposed strut that provides a maximum bearing area for supporting the strut.

Another object is to provide a method of mounting a rigid strut or supporting brace for a fence or the like between the fence and a bearing pad adapted to be driven into the soil adjacent the fence wherein the act of driving the pad into the soil produces a firm seated engagement of the strut in its respective seats on the fence and on the pad.

Other objects will appear from the specification below.

IN THE DRAWINGS

DETAILED DESCRIPTION

Figure 1:
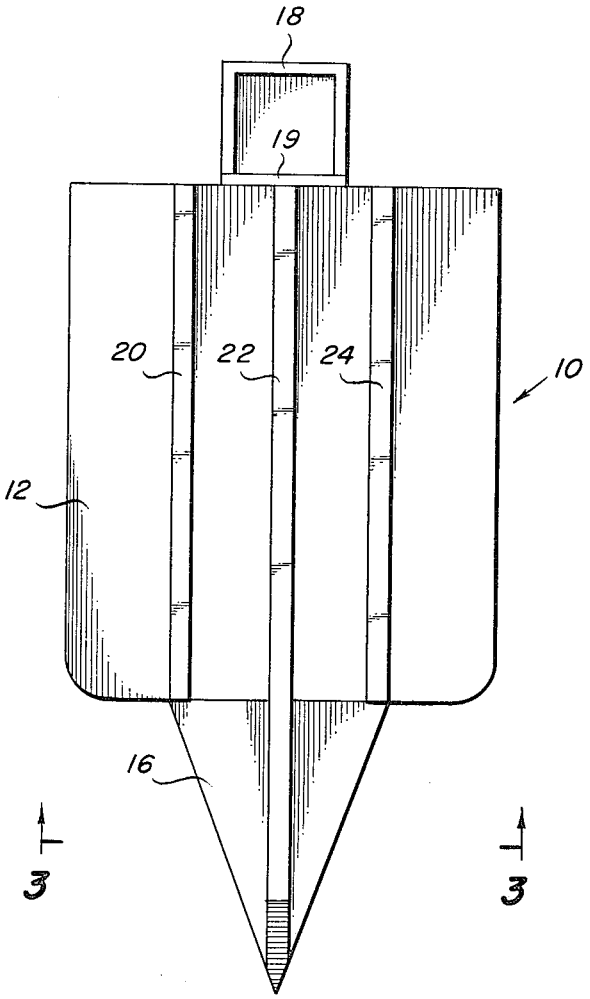
FIG. 1 is a front elevation of the bearing pad.
Figure 2:
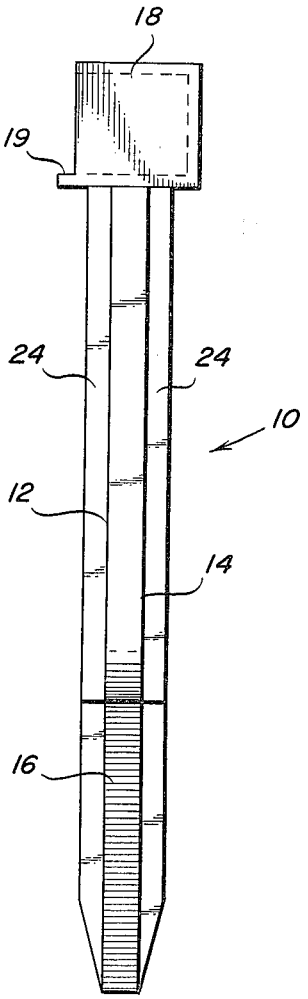
FIG. 2 is a side elevation of the pad.
Figure 3:
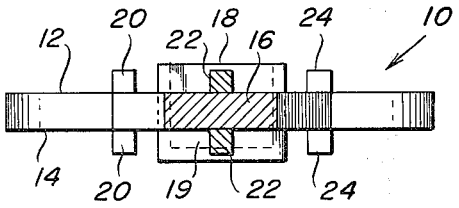
FIG. 3 is a view looking along line 3–3 of FIG. 1.

The bearing pad 10 is a planar bearing plate having a fron surface 12 and a rear surface 14. The main body of the pad is preferably a rectangular shape and is provided with a driving point 16 on one edge and a bearing or support socket 18 on an opposite edge. The driving point 16 and main body are preferably formed from one piece of plate with the front and rear surfaces of each co-extensive with one another. Guide fins 20, 22 and 24 are formed integral, such as by welding, with the front and rear surfaces 12 and 14 of the bearing pad, the fins 22 extending along the vertical centerline of the pad from the top edge of the body to near the bottom tip of point 16. At their upper ends, fins 22 support the bottom wall 19 of the support socket 18 and the lower ends of fins 22 near the tip of the point, may be tapered for easy driving into the soil.

The pad 10, socket 18 and fins are formed of a heavy plate metal and the fins reinforce the pad which is adapted to sustain substantial loads such as repeated blows from a sledgehammer. The walls of the support socket 18 are designed to receive the lower end of the support strut 30, as shown in FIG. 4, and the top of socket 18 serves as a striking surface for a sledge hammer used to drive the bearing pad into the ground.

The total height of the assembly is approximately 20" with the main body of the bearing pad approximately 11" high by 8" wide. The driving point is approximately $6\frac{1}{2}$" high and the support socket has an interior dimension of approximately 2"×2". The pad socket and point is formed from approximately $\frac{1}{4}$" thick galvanized steel plate. The guide fins may be of somewhat less thickness than the main body. It is noticed the lower outer edges of the main body are rounded so as to achieve wheel penetration as the assembly is driven into the soil.

The pad is shown in association with a strut used to support a fence such as may be found along a motor highway, wherein posts 26 support flexible rails 28 against which automotive vehicles may accidently impinge. Also, it can be used with other fencing such as woven wire farm fencing. In order to provide adequate support for the fence, it is desirable to provide spaced supports along its back side and for this purpose a plurality of spaced struts 30 may be braced against the fence.

Figure 4:
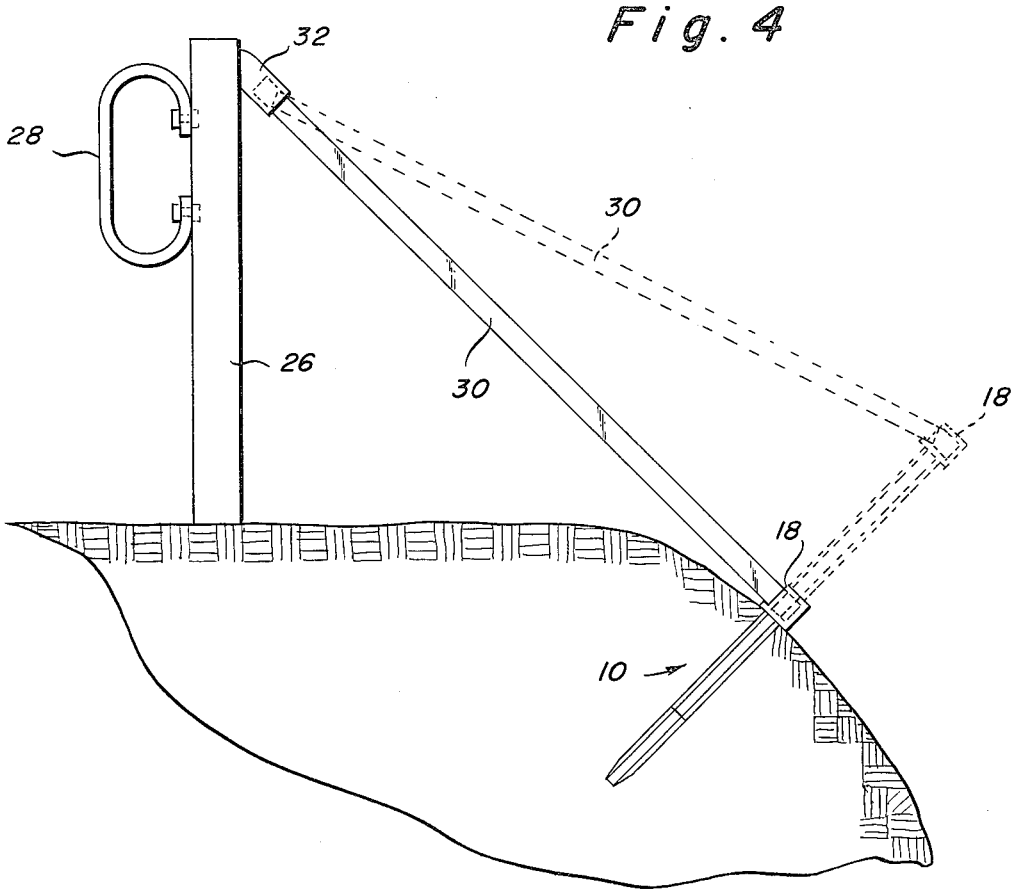
FIG. 4 is a side elevation showing the pad and the strut it supports, in relation to a fence and the soil.

At its upper end the strut 30, as shown in FIG. 4, is adapted to be engaged in a bearing cup 32 integral with the rear side of post 26 and at its lower end the strut is designed to be seated in the support socket 18 integral with the upper edge of the bearing pad. The openings to the bearing cup 32 and socket 18 for receiving the respective ends of the strut are sufficiently large to permit a slight rotation of the ends of the strut relative to their seats as the pad is driven home whereby the ends of the strut may move longitudinally into each seat so that the ends of the struts bottom neatly in their seats, s shown in full lines in FIG. 4.

In making use of this bearing pad, the strut itself may be temporarily fitted into socket 32 and used to mark off the distance from post 26 to the point on the ground where the bearing pad is to be driven. When the strut is inserted in the socket 32 and the free end of the strut is laid on the ground, it is apparent that the pad should be driven into the soil at this location so that socket 18, integral with the bearing pad, will be driven home to the position shown in FIG. 4 with its bottom wall just even with the soil.

After marking off the proper location for driving pad 10 into the soil, the strut can then be raised to the dotted line position shown in FIG. 4 and the driving point 16 of the bearing pad can be placed on the mark. With the strut stretched between sockets 32 and 18, the mechanic can hold the strut and pad together while he uses a sledgehammer to drive the point 16 into the ground. The pad may be manually guided with one hand while the mechanic handles the sledge with the other hand and, because of the sharpness of point 16, the pad can be easily started into the soil with the one-handed driving stroke until substantially all of the point 16 is buried.

When the point 16 is buried in the soil, it has a sufficient length and width to fully support the pad 10 so that the mechanic may now use two hands to manipulate the sledgehammer to drive the pad into the ground. As the driving action progresses, the strut moves from its position where it forms the hypotenuse of a right triangle, as shown in the dotted line in FIG. 4, to become a leg of that triangle when the pad is properly driven home. Since the strut is then disposed at a right angle with respect to the plane of pad 10, any thrust transmitted from the fence through the strut to the pad is dissipated into the soil over the entire area of the pad. It is also to be noted that as the pad is driven into the soil that the strut in the position as a hypotenuse of a right triangle becomes shorter and shorter as the angle at seat 32 becomes smaller and smaller as the strut swings with the downwardly moving support socket 18. Thus, as the hypotenuse tends to become shorter, the two ends of the strut 30 are forced to move longitudinally into their supports 18 and 32 at its opposite ends. When the pad has been driven into the soil until the bottom wall 19 of socket 18 is level with the surface of the soil, strut 30 will have moved into the solid line position shown in FIG. 4, where it is now one leg of a right triangle and the ends of the strut are in tight engagement with the bottoms of both socket 18 and cup 32.

The fins 20, 22 and 24 on the front and back faces of the pad stiffen the body to hold it against bending as the pad transmits the bearing thrust of strut 30 evenly to all portions of the pad. The primary function of fins 20, 22 and 24, however, is to act like a keel to guide the pad straight into the ground at the proper angle established by the intial driving of point 16 into the soil and to offer resistance against sidewise movement. As pointed out above, when the pad is driven into the soil in a plane at a right angle to the longitudinal axis of the strut when the strut seated in socket 32 at one end and is tangent with the surface of the soil at its lower end, the relative movement of the pad and strut as the pad is driven into the soil, produces the proper tightening of the strut into its bearing sockets 18 and 32. The fins are engaged firmly in the soil and prevent the pad from being turned off its course as it is being driven into the soil and thus stabilize the pad.

While the above description covers the preferred structure and method of using my invention, it is possible that modifications thereof will occur to those skilled in the art that may fall within the scope of the following claims.

What is claimed is:

1. A bearing pad adapted to be driven at a diagonal angle by a sledge-hammer or the like into compacted earth adjacent a fence, the pad being adapted to support a bracing strut disposed at approximately a right angle to said pad for absorbing thrusts such as may be imposed upon such fence, said pad comprising a main body having a large planar bearing area defined by edges, a driving point forming an extension of said body disposed on the lower edge thereof with said point tapering to a point at the lower portion, said bearing area and driving point having substantially coextensive front and back sides, a socket having an opening to recieve the end of a bracing strut and wall including a bottom and top striking surface integral with the upper edge of said pad with said opening extending at right angles to said pad, said socket being formed of metal sufficiently heavy to sustain repeated blows of a sledge hammer made to said top striking surface to drive said bearing pad into the soil and guide fin formed integral with and extending through the centerline across at least either the front or back side of said area and said point and terminating at its upper end at said socket bottom to add support whereby said area and point are ridigified and supported from sidewise movement and said socket is supported to resist the forces used to drive said pad into place.

2. A bearing pad as in claim 1 wherein a centerline guide fin is formed on both the front and back sides of said area and said point.

3. A bearing pad as in claim 2 wherein additional guide fins are formed integral with said planar bearing area on both its front and back sides and said additional fins are spaced from and are disposed in parallel relationship to but on opposite sides of said centerline.

4. A bearing pad as in claim 2 wherein said centerline guide fins extend across the front and back sides of said bearing area along the centerline thereof from said point to said socket, said socket being disposed on said oppositely disposed edge from said point and being supported on said edge in engagement with the ends of the guide fins on the front and back sides of the body.

5. A method of using a bearing pad, the front and back faces of which are wide planar surfaces, said pad being driven into compacted soil for supporting a bracing strut that is engaged at an upper end in a support means spaced above the soil and on the back side of a fence disposed alongside a highway or the like, the strut being supported at its other end in a bearing socket on the pad at the level of the soil, the pad having a driving point on one edge with said socket for supporting said one end of the strut on the pad being disposed on an edge of the pad opposite from the point, comprising picking a spot on the surface of the soil for engaging the driving point of the pad on the soil; said point being positioned a distance away from the strut support means on the back side of said fence, which distance is equal to the length of said strut; mounting the strut in said support means on the back of the fence and in the bearing socket on said pad; driving the driving point of the bearing pad into the soil in a direction such that the strut is disposed at a right angle to the planar surface of the pad when the pad is in its final position with said second bearing socket level with the soil.

6. A method of using a bearing pad, the front and back faces of which are wide planar surfaces, said pad being driven into compacted soil for supporting a bracing strut that is engaged on one end in a support means spaced above the soil on the back side of a fence disposed alongside a highway or the like and is supported on its other end in a second bearing socket on the pad, the pad having a driving point on one edge with said second socket being disposed on an edge of the pad opposite from the point, comprising marking a spot on the surface of the soil for engaging the driving point of the pad on the soil; said point being positioned a distance away from the strut support means on the back side of said fence, which distance is equal to the length of said strut; mounting said strut in said support means on the back of the fence and in said second bearing socket on said pad to form the hypotenuse of a right triangle; and driving the pad into the soil until the strut moves from a position as the hypotenuse of a right triangle, into a position that it is a leg of the right triangle so that the planer surface of the pad is disposed at right angle to the strut.

* * * * *